US006652175B2

(12) United States Patent
Chang

(10) Patent No.: US 6,652,175 B2
(45) Date of Patent: Nov. 25, 2003

(54) STRUCTURE OF A HEATING NOZZLE FOR A GLUE GUN

(75) Inventor: Yin-Kuang Chang, Taipei (TW)

(73) Assignee: Gene-Yu Enterprise Ltd., Taipei (TW)

( * ) Notice: Subject to any disclaimer, the term of this patent is extended or adjusted under 35 U.S.C. 154(b) by 0 days.

(21) Appl. No.: 10/167,942

(22) Filed: Jun. 13, 2002

(65) Prior Publication Data

US 2002/0192005 A1 Dec. 19, 2002

(30) Foreign Application Priority Data

Jun. 15, 2001 (TW) ..... 90210048 U

(51) Int. Cl.[7] ..... A46B 11/08; B46D 5/62; H05B 1/00

(52) U.S. Cl. ..... 401/2; 401/1; 222/146.2; 219/233; 219/229

(58) Field of Search ..... 401/2, 1; 222/113, 222/146.1, 146.2, 146.5, 567, 570; 126/226, 284; 219/59.1, 616, 158, 201, 209, 221, 227, 229, 233, 240, 476, 477

(56) References Cited

U.S. PATENT DOCUMENTS 3,298,572 A * 1/1967 Newton ..... 401/2
4,639,155 A * 1/1987 Schuster et al. ..... 401/2
4,706,852 A * 11/1987 Borst et al. ..... 222/146.2

* cited by examiner

*Primary Examiner*—David J. Walczak
(74) *Attorney, Agent, or Firm*—Leong C. Lei

(57) ABSTRACT

A structure of a heating nozzle for a glue gun includes a nozzle, a rubber ring and a rubber tubular member, the nozzle being provided with two heaters formed by a heat resistant and highly heat efficient element and assembled with the rubber ring and the rubber tubular member to form a nozzle assembly, wherein by means of connection in series and parallel with a battery chamber, a control switch and a LED indicator, the nozzle assembly is supplied with a 6-volt DC power source or externally connected with an AC power source or a power adapter to make the nozzle to melt a glue rod for proceeding with adhesion operation, whereby the length of the heating nozzle is decreased and can be pre-heated within a very short time and the nozzle is compact in size, the heating efficiency is high and power consumption is small, and the glue can be cooled rapidly, so as to avoid melting glue flowing out of the glue gun when the glue gun is turned off, and a direct heating method is used to melt the glue.

1 Claim, 5 Drawing Sheets

STRUCTURE OF A HEATING NOZZLE FOR A GLUE GUN

BACKGROUND OF THE INVENTION

1. Field of the Invention

This invention utilizes a highly heat efficient heater to transmit heat to the heating nozzle of a glue gun, and only uses direct DC power source (six-watt battery) to provide energy to the heating nozzle to provide high temperature and high thermal efficiency to melt glue rods to enable the operation of the glue gun.

2. Description of the Prior Art

The heat transfer method of the conventional glue gun generally utilizes an external AC power source to provide heat of high temperature to the heating nozzle via a heater. As the heater is bulky in volume, it is impossible to be located close to the outlet of the glue gun. Hence, it is necessary to use a long tube to transmit melted liquid glue to the outlet of the glue gun. Further, it is necessary to transfer heat to the tube, and to mount several pre-heaters around the tube. The pre-heaters are energized by AC power to melt the glue rod within the tube, so as to proceed with the adhering operation of the glue gun. However, a large amount of energy will be wasted in the transmission to the tube, and the time for pre-heating is long. As a consequence, it is necessary to wait for the heating of the glue gun for two to three minutes before it can melt the glue rod. Although the pre-heating time is not very long, since the melted glue within the tube will not be cooled at once after the glue gun is turned off, it will therefore make the melted glue flow out of the gun, even after the glue gun is turned off. Accordingly, the operation is very inconvenient, and the glue rod is wasted.

Therefore, it is an object of the present invention to provide an improvement in the heat transmission structure for a glue gun so as to obviate and mitigate the above-mentioned drawbacks.

SUMMARY OF THE INVENTION

It is the primary object of the present invention to provide a structure of a heating nozzle of a glue gun, which includes two heaters (preferably made of one which is formed by sintering a heating resistor enclosed with ceramic), so as to decrease the length of the heating nozzle, and can be pre-heated within a very short time and is compact in size, and wherein heating efficiency is high and power consumption is small, and the glue can be cooled rapidly, so as to avoid melting glue flowing out of the glue gun when the glue gun is turned off, and a direct heating method is used to melt the glue.

It is another object of the present invention to provide a structure of a heating nozzle of a glue gun which utilizes four number four batteries to supply power to the heating nozzle, and may be also connected with an external power supply or power adaptor to obtain power.

It is a further object of the present invention to provide a structure of a heating nozzle for a glue gun includes a nozzle, a rubber ring and a rubber tubular member, the nozzle being provided with two heaters formed by a heat resistant and highly heat efficient element and assembled with the rubber ring and the rubber tubular member to form a nozzle assembly, wherein by means of connection in series and parallel with a battery chamber, a control switch and a LED indicator, the nozzle assembly is supplied with a 6-volt DC power source or externally connected with an AC power source or a power adapter to make the nozzle to melt a glue rod for proceeding with adhesion operation.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
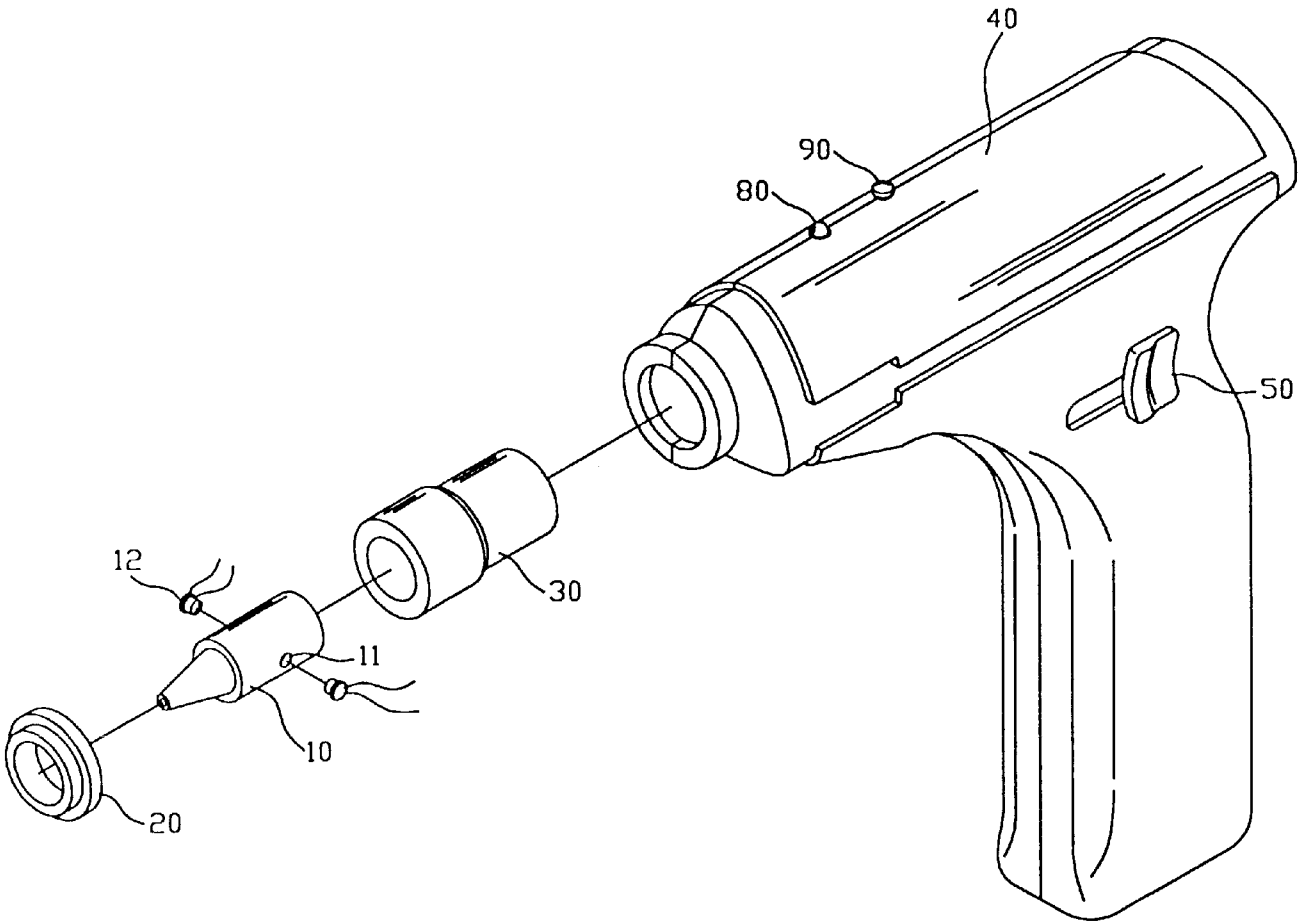
FIG. 1 is an exploded view of the present invention.
Figure 2:
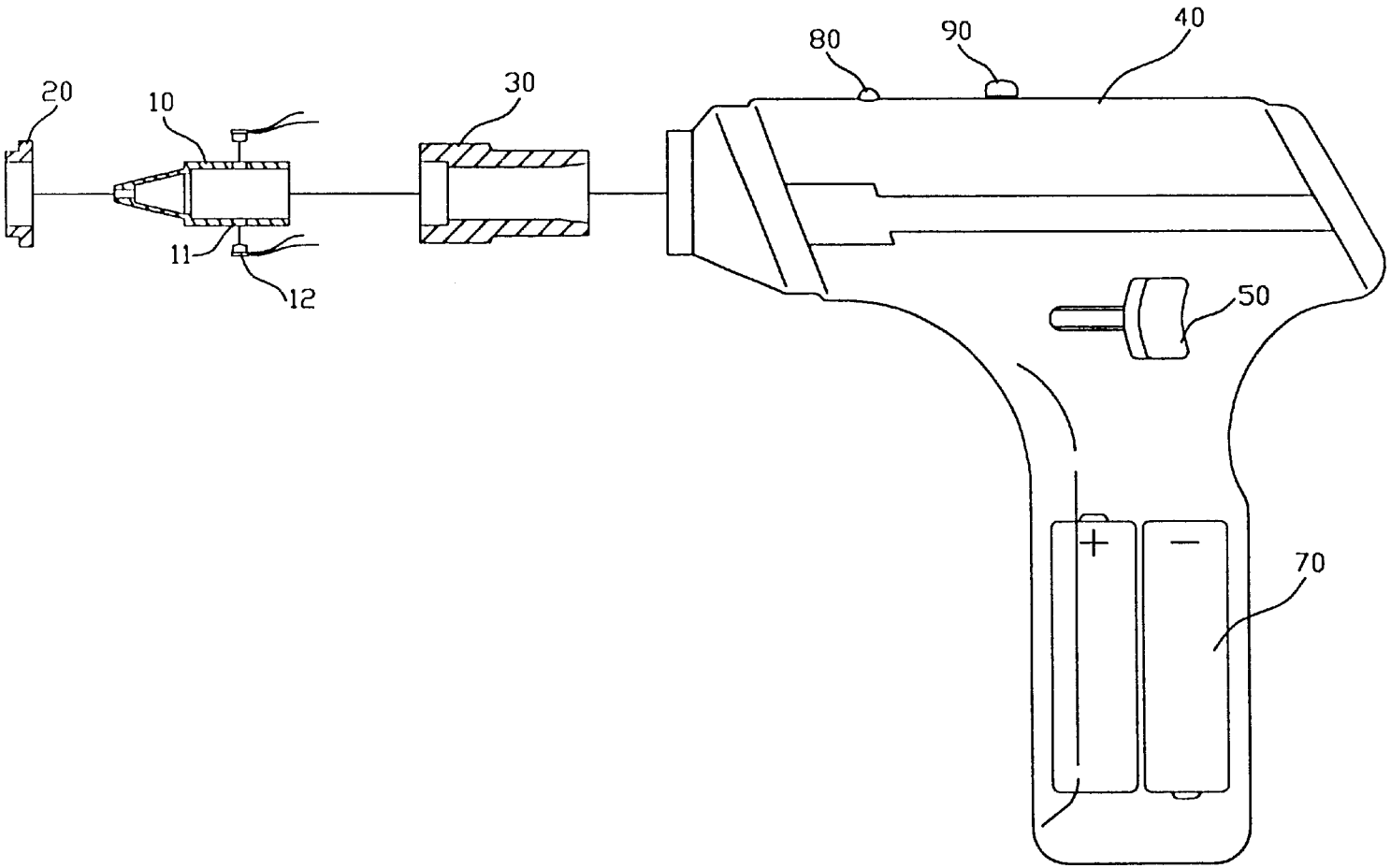
FIG. 2 is an exploded sectional view of the present invention.

Referring to FIGS. 1 and 2, the heating nozzle for a glue gun according to the present invention comprises a nozzle 10, which is made of heat-resistant metal. The nozzle 10 is formed with two through-holes 11, in each of which is fitted a heater 12 by means of adhesion or soldering. The heater 12 is formed by a heat resistant and highly heat efficient element. A stepped rubber ring 20 is put over the heating nozzle 10 so that the nozzle 10 can be firmly mounted within the body 40 of the glue gun. Further, the rubber ring 20 can effectively isolate the heat generated from the nozzle 10 from the housing 40. The rear end of the nozzle 10 is connected with a rubber tubular member 30 for guiding a glue rod 60 into the nozzle 10.

Figure 3:
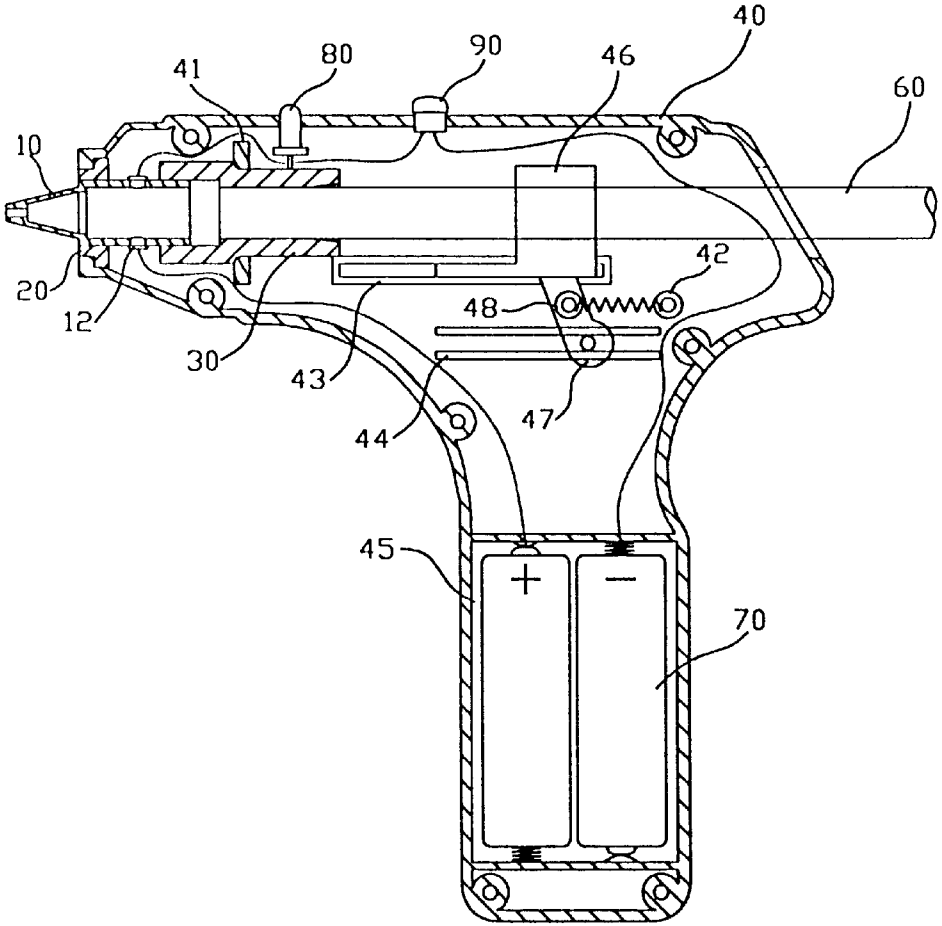
FIG. 3 is a sectional view of the present invention.
Figure 4:
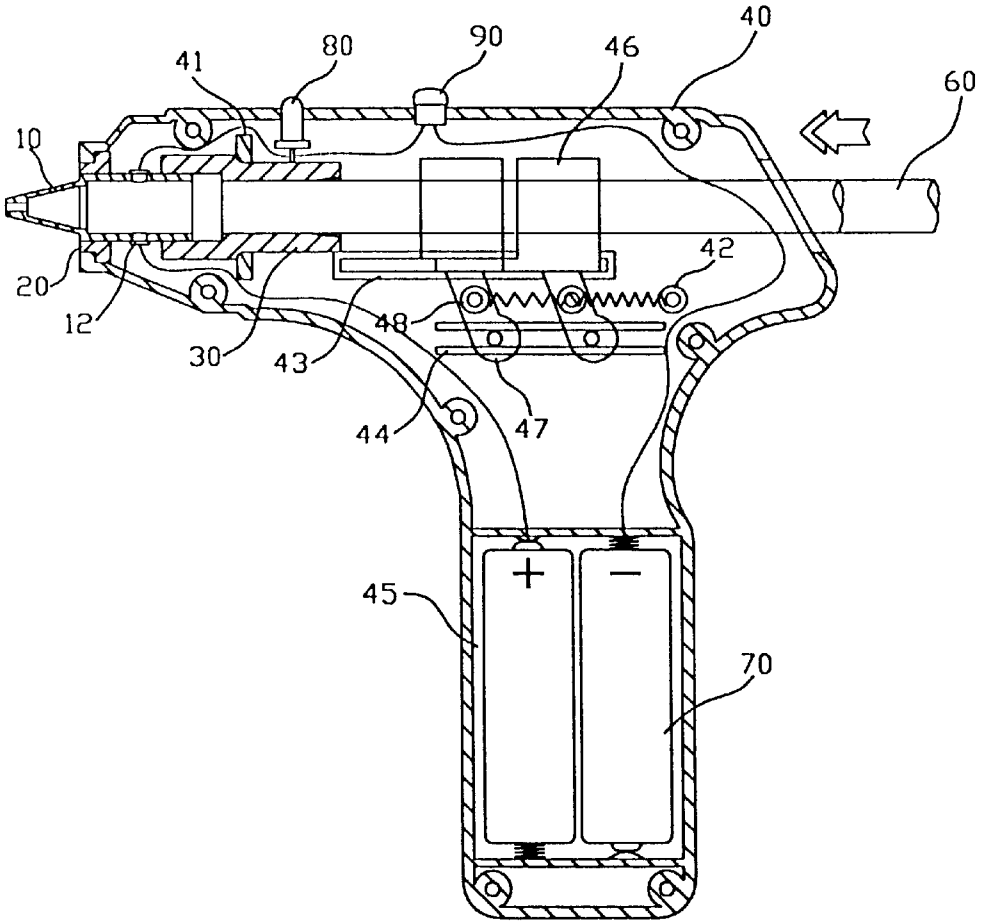
FIG. 4 illustrates the operation of the present invention.
Figure 5:
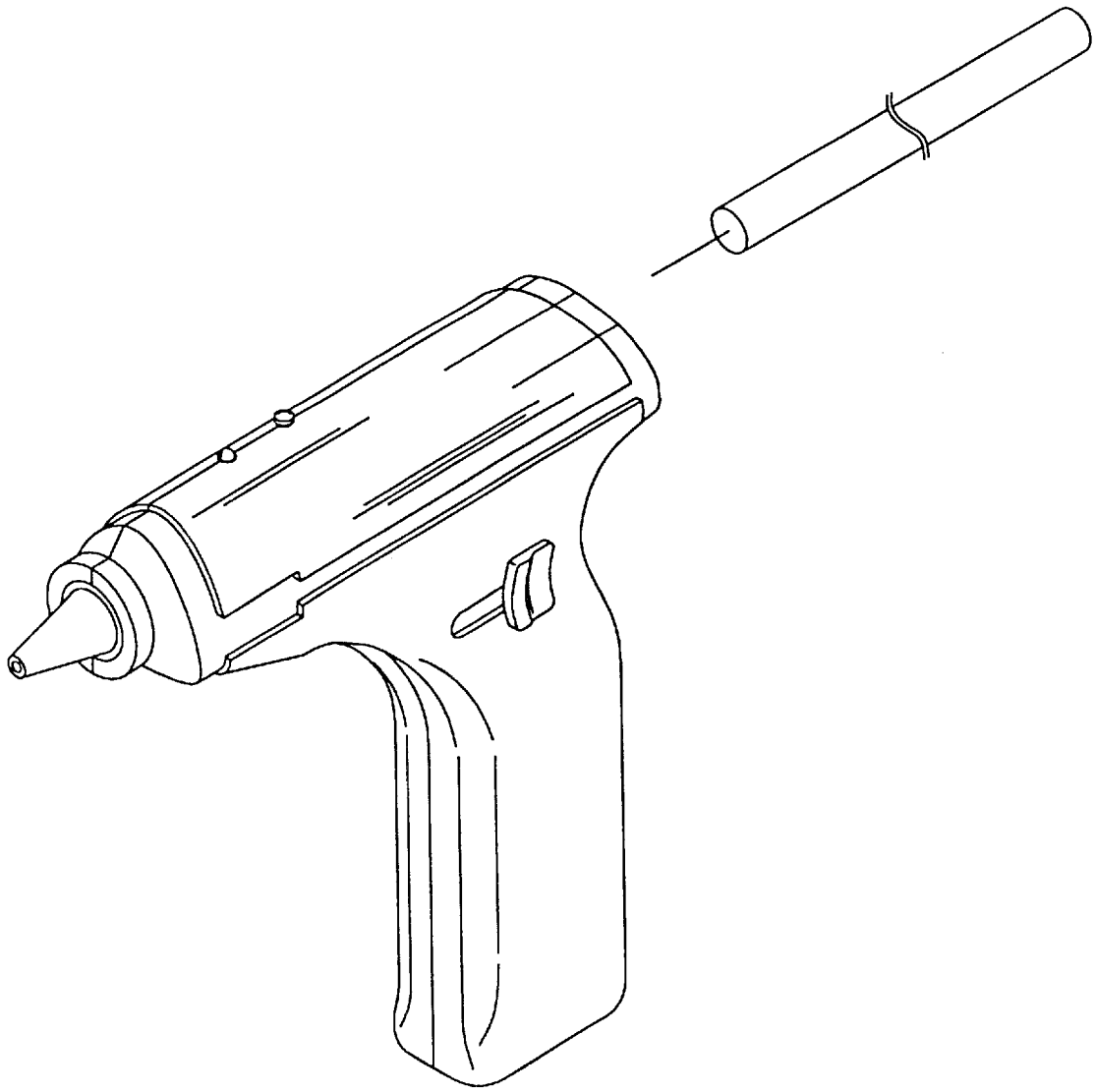
FIG. 5 is a perspective view of the present invention.

Referring to FIGS. 3 and 4, the nozzle 10, the rubber ring 20 and the rubber tubular member 30 are assembled into a nozzle assembly, which is mounted on a fixing seat 41 in the housing 40, so that the nozzle assembly is firmly fixed in position. The rear portion of the housing 40 is provided with a pushing mechanism for transmitting the glue rod 60. The pushing mechanism includes a groove 43 for guiding the movement of the pusher 46. The groove 44 is provided below the groove 43 for guiding a link 47. The link 47 has a pin 48 which is connected with an end of a spring. The other end of the spring is connected with a fixed pin 42 of the housing 40. The link 47 is connected with a button 50 for pushing the pull rod into the rubber tubular member 30.

The housing 40 is a handle formed with a chamber 45 in which are fitted four number four batteries. The batteries 70 are connected in series for supplying power to the heater 12. The top of the housing 40 is provided with a control switch 90 and an LED indicator 80. The heater 12 is connected in parallel with the circuit. The other end of the heater is connected to the negative terminal of the battery chamber 45. The circuit is connected to the LED indicator 80, the control switch 90, and the positive terminal of the battery chamber 45. The LED indicator 80 is connected with the low power resistor (for example, a ⅛ watt resistor) in series for lowering the current consumed by the LED indicator (for instance, when the resistance of the resistor is 600 ohms, the current consumption will be only 10 mA).

In conclusion, the structure of a heating nozzle for a glue gun according to the present invention utilizes a heating nozzle to generate heat and since the heat efficiency of the heater is very high and the heater is small in size it can be energized by a six volt DC power source. Further, the present invention can be connected with an external power supply or a power adaptor to increase the temperature of the heating nozzle to melt the glue rod for proceeding with adhesion operation.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A glue gun with a heating nozzle structure, comprising a nozzle, a rubber ring and a rubber tubular member, said nozzle being provided with two heaters formed by a heat resistant and highly heat efficient element and assembled with said rubber ring and said rubber tubular member to form a nozzle assembly, and a pushing mechanism for guiding a glue rod into said rubber tubular member, wherein by means of connection in series and parallel, said nozzle assembly is supplied with DC power source to make said nozzle to melt a glue rod for proceeding with adhesion operation.

* * * * *